US009003732B2

(12) United States Patent
Behrens et al.

(10) Patent No.: US 9,003,732 B2
(45) Date of Patent: Apr. 14, 2015

(54) MOBILE PARTITIONING WALL

(75) Inventors: Jan-Gerd Behrens, Oldenburg (DE); Carsten Klapproth, Olodenburg (DE); Rolf Warns, Olvelgönne (DE)

(73) Assignee: Dorma GmbH + Co. KG, Ennepetal (DE)

( * ) Notice: Subject to any disclaimer, the term of this patent is extended or adjusted under 35 U.S.C. 154(b) by 1011 days.

(21) Appl. No.: 12/083,167

(22) PCT Filed: Sep. 12, 2006

(86) PCT No.: PCT/EP2006/008854

§ 371 (c)(1), (2), (4) Date: Apr. 7, 2008

(87) PCT Pub. No.: WO2007/039044

PCT Pub. Date: Apr. 12, 2007

(65) Prior Publication Data

US 2009/0255193 A1 Oct. 15, 2009

(30) Foreign Application Priority Data

Oct. 6, 2005 (DE) ..... 10 2005 048 156

(51) Int. Cl.
*E04C 2/00* (2006.01)
*E04B 2/82* (2006.01)

(52) U.S. Cl.
CPC ..... *E04B 2/827* (2013.01)

(58) Field of Classification Search
USPC ..... 52/782.1, 783.1, 784.14, 793.1, 794.1, 52/796.1, 309.9, 309.14, 283, 481.1, 578; 156/279, 290, 292; 181/290, 292
See application file for complete search history.

(56) References Cited

U.S. PATENT DOCUMENTS

| | | | | | |
|---|---|---|---|---|---|
| 3,084,770 | A | * | 4/1963 | Wirsing, Jr. | 428/593 |
| 3,107,400 | A | | 10/1963 | Anderson | |
| 3,282,615 | A | * | 11/1966 | Darby et al. | 52/783.18 |
| 3,309,816 | A | | 3/1967 | Malone | |
| 3,400,504 | A | | 9/1968 | Neisewander | |
| 3,535,198 | A | * | 10/1970 | Bloom | 428/317.7 |
| 3,638,376 | A | * | 2/1972 | Howes et al. | 52/126.4 |
| 3,769,767 | A | * | 11/1973 | Scott | 52/145 |
| 3,869,326 | A | * | 3/1975 | Matzke | 156/209 |
| 4,606,959 | A | * | 8/1986 | Hillinger | 428/116 |
| 4,635,418 | A | * | 1/1987 | Hobgood | 52/239 |
| 4,759,964 | A | * | 7/1988 | Fischer et al. | 428/116 |
| 5,106,668 | A | * | 4/1992 | Turner et al. | 428/116 |

(Continued)

FOREIGN PATENT DOCUMENTS

| | | |
|---|---|---|
| AT | 324 638 | 9/1975 |
| DE | 24 04 874 | 8/1915 |

(Continued)

OTHER PUBLICATIONS

Search Report dated Oct. 31, 2006 issued for the underlying International PCT Application No. PCT/EP2006/008854.

*Primary Examiner* — Jeanette E Chapman
*Assistant Examiner* — James Buckle, Jr.
(74) *Attorney, Agent, or Firm* — Cozen O'Connor

(57) ABSTRACT

A mobile partitioning wall is disclosed and provided with several wall elements, which are displaceably suspended at running rails. The wall elements have a structure that is simple to manufacture and to mount and is universally usable. The wall elements are formed without supporting frame.

20 Claims, 3 Drawing Sheets

(56) References Cited

U.S. PATENT DOCUMENTS

| | | | | |
|---|---|---|---|---|
| 5,179,810 | A * | 1/1993 | Gename et al. | 52/240 |
| 5,338,594 | A * | 8/1994 | Wang et al. | 428/117 |
| 5,419,093 | A * | 5/1995 | Wei | 52/793.1 |
| 5,445,861 | A * | 8/1995 | Newton et al. | 428/116 |
| 5,518,796 | A * | 5/1996 | Tsotsis | 428/116 |
| 5,665,447 | A * | 9/1997 | Greaves et al. | 428/68 |
| 5,667,866 | A * | 9/1997 | Reese, Jr. | 428/116 |
| 5,851,336 | A * | 12/1998 | Cundiff et al. | 156/272.2 |
| 6,156,146 | A * | 12/2000 | Cundiff | 156/213 |
| 6,372,078 | B1 * | 4/2002 | Melchert et al. | 156/298 |
| 6,490,832 | B1 | 12/2002 | Fischbach et al. | |
| 6,508,910 | B2 * | 1/2003 | Zhou et al. | 156/307.3 |
| 6,509,081 | B1 * | 1/2003 | Diamond | 428/131 |
| 6,679,969 | B1 * | 1/2004 | Fournier et al. | 156/245 |
| 6,711,872 | B2 * | 3/2004 | Anderson | 52/783.17 |
| 7,124,578 | B2 | 10/2006 | Noel | |
| 7,288,164 | B2 * | 10/2007 | Roberge et al. | 156/292 |

FOREIGN PATENT DOCUMENTS

| | | |
|---|---|---|
| DE | 2 240 143 | 2/1974 |
| DE | 196 34 391 | 3/1998 |
| DE | 20 2005 001 118 | 5/2005 |
| EP | 0 201 104 | 11/1986 |

* cited by examiner

MOBILE PARTITIONING WALL

CROSS REFERENCE TO RELATED APPLICATIONS

This is a U.S. national stage of International Application No. PCT/EP2006/008854, filed on Sep. 12, 2006. Priority is claimed on German Application No. 10 2005 048 156.6, filed on Oct. 6, 2005.

BACKGROUND OF THE INVENTION

1. Field of the Invention

The invention relates to a mobile partitioning wall with several wall elements, which are displaceably disposed at running rails.

2. Description of the Related Art

A mobile partitioning wall with several wall elements, which are displaceably guided in a running rail, is known from DE 24 04 874. Each wall element has a supporting structure, which is formed by a surrounding frame consisting of profiles. Covering panels are mounted to both sides of the frame and, moreover, further add-on and accessory parts are attached thereto. The hollow space between the covering panels and the frame is filled with thermally insulating and sound-absorbent materials.

The frame-based supporting structure results in wall elements having a high weight and requires therefore suspension devices with a corresponding stable configuration. With such a structure, the increasing requirements with regard to thermal and sound-insulation can only be satisfied when using additional respectively thicker covering panels, while increasing the overall weight.

As mobile partitioning walls, due to varying installation situations and dimensions, are individually manufactured, in particular the realization of the frame requires an expensive and precise dimensional manufacturing and connecting of the profiles. A provision and production of standardized components for such wall elements is only feasible to a very limited extent.

SUMMARY OF THE INVENTION

The object of the invention is to provide a mobile partitioning wall having wall elements that are technically simple to manufacture and to install and are universally applicable. According to the invention, the wall elements are formed without a supporting frame. The invention is applicable to both automatically and manually displaceable wall elements of partitioning walls.

The mobile partitioning wall according to the invention has the advantage that, on account of the self-supporting structure of the wall elements, manufacturing and mounting are considerably simplified. Unlike the already known supporting frame structure, a panel-shaped and layered composite structure with sandwich technique allows for a simple and extensively automated manufacturing.

The selection of the materials and their layering are determined in particular considering weight-specific and acoustic aspects. In addition, the external layers can be selected considering visual and practical aspects. Complicated manufacturing of a supporting frame structure is eliminated, because the basic structure of a wall element can be made by just cutting to size and connecting the layers.

The different materials of a layer are kept as supplies in a panel-shape and are cut to the required dimension when needed. In this case, dimensioning the layers in a raster measure is advantageous, in order to efficiently realize the different dimensions. The basic structure of the wall element is built by arranging layered panels and feeding adhesives and filling compounds. Thus the variable selection and disposition of layers and filling materials allow for quickly and easily replying to specific customer needs. In a particular embodiment, it is likewise possible to combine pre-fabricated layered structures or even to combine complete basic structures, again as a separate partial layer, to form a wall element.

The surrounding border area of the wall element, at least sectionally, is formed as a profile, in order to achieve a positive connection to the border areas of adjoining wall elements. Such border areas are formed in particular at the vertical edges, which border areas cooperate with a complementarily formed border area of the adjoining wall element and thus provide a soundproof and stable connection.

The corresponding profiling may be realized directly through shaping measures during the manufacturing of the core or through corresponding inserts, such as moulded plastic material parts or metallic profiles. The profiling can be made based on a tongue and groove system. Other positive configurations, such as undulated, semicircular, circular or trapezoidal are suitable as well. In addition, joints made for example from rubber or magnetic materials may be placed at these borders as well.

Smaller basic units having such profiled border areas allow for example to create large-surface wall elements in horizontal and vertical extensions.

Furthermore, the mounting of modular and variable add-on parts and of functional units is realized at horizontal and vertical edges. For this purpose, recesses, to which the add-on parts are attached directly or to mounting elements premounted at that location, are provided in the wall elements. Preferably already during the manufacturing of the basic structure, corresponding profiles or mounting elements are machined into the recesses.

The manufacturing and mounting expense is considerably reduced altogether, because individual mounting schemes do not need to be figured out any more. In particular, the manual manufacturing steps are considerably reduced, because a major portion is now automatized. Moreover, the wall element can be likewise shipped as an assembly kit. Final measures for cutting the panels to size, in particular for the add-on parts, and their final mounting can be done on the installation site as well.

The wall element according to the inventive structure has a core which, on both sides, is covered by one exterior shell, respectively. Preferably, the exterior shell is multi-layered and comprises an exterior cover layer, a middle layer and an interior layer. Overall, the two exterior shells are formed to be heavy and soundproof and are sonically separated by the preferably soft core material. Through the full connection, preferably bonding, all layers and materials of the wall element are combined into a self-supporting unit. The sound insulation can be realized at a lower expense, because the selection of appropriate materials and their assembling already result in a considerable improvement. With the intention to improve the rigidity of the wall element while maintaining the sound insulation at the same time, the contact surfaces, depending on the material selection, are profiled.

Through the selection of various different materials, the use of panel-shaped and foamed layers and their connection to a structure in a sandwich form, the individual properties are advantageously combined in such a way that they sum up to a considerable improvement. The wall element, for example, has considerably higher bending and torsional rigidities than the sum of the properties of the individual layers of the exterior shell and the core. Such structured panels transfer substantial loads. The structure of the exterior shell, as well as the thickness and density of the core are decisive factors. Compared to a profile frame structure, the resultant wall element has a reduced wall thickness and a lower weight with an increase in stability.

The core material is made from a honeycomb structure, which in particular consists of paper or aluminum. Alternatively, solid material made from polystyrene foam, PU-foam, mineral wool, rock wool or the like can be used.

Preferably, the exterior shells are formed with several layers. Metallic materials, such as sheet steel or sheet aluminum, and plastic material (PVC, PC), laminated materials, fibreglass reinforced plastics (GRP), gypsum, wood, cork, etc. are suitable for the middle layer. The layer, disposed on the inside between the middle layer of the exterior shell and the core, serves as an increase to the shell weight and as a damping material and preferably consists of bitumen. This middle layer serves at the same time as the support for the exterior cover layer, which forms the visible surface. This may be a priming film, a laminate, laminar material or melamine resin. Furthermore, veneers, textile or glass surfaces are possible.

Bonding materials and bonding techniques are used for connecting the individual layers of the exterior shell. The so-called long fibre injection method (LFI) is used as the preferred method. In this case, fibreglass strands are cut and, in a single operational step, are fed simultaneously with PUR-components to a tool device and blended. The finished mixture is then sprayed between the corresponding layers of the exterior shell and, once hardened, creates a permanent connection.

A particularly advantageous of the wall element is achieved with a soft PUR-foam core or melamine foam, which is surrounded on both sides by a weighting layer of bitumen. Then the middle layer of the exterior shell follows, consisting of GRP enveloped paper honeycombs filled with PU-foam, and has an exterior cover layer formed according to customer specifications. Such a combination of materials has excellent acoustic properties offering the optimum solution with regard to the parameters of sound insulation and weight per unit area.

Such structured wall elements are suitable to build partitioning walls having various most different configurations. In particular, the substantial weight reduction achieves a lower load on the suspension devices and on the drive means. On the other hand, by improving the sound insulation, the number of application variants is increased.

The wall elements can be formed as a solid element, passage door, angle element, window element, compensating element, swing leaf, double-action leaf or as following automatic doors. All wall elements can be moved out of the axis of the partitioning wall and parked at a predetermined location in a space-saving manner. Each wall element is displaceable, at one or two points, by means of carriages in a running rail, which is attached to the ceiling.

The overall partitioning wall fulfils the requirements of the thermal insulation regulation such that, even at low outside temperatures, there are no disadvantages as to energy and cost.

BRIEF DESCRIPTION OF THE DRAWINGS

The invention will now be described in more detail by means of one exemplary embodiment in conjunction with the drawings, in which.

DETAILED DESCRIPTION OF THE PREFERRED EMBODIMENTS

Figure 1:
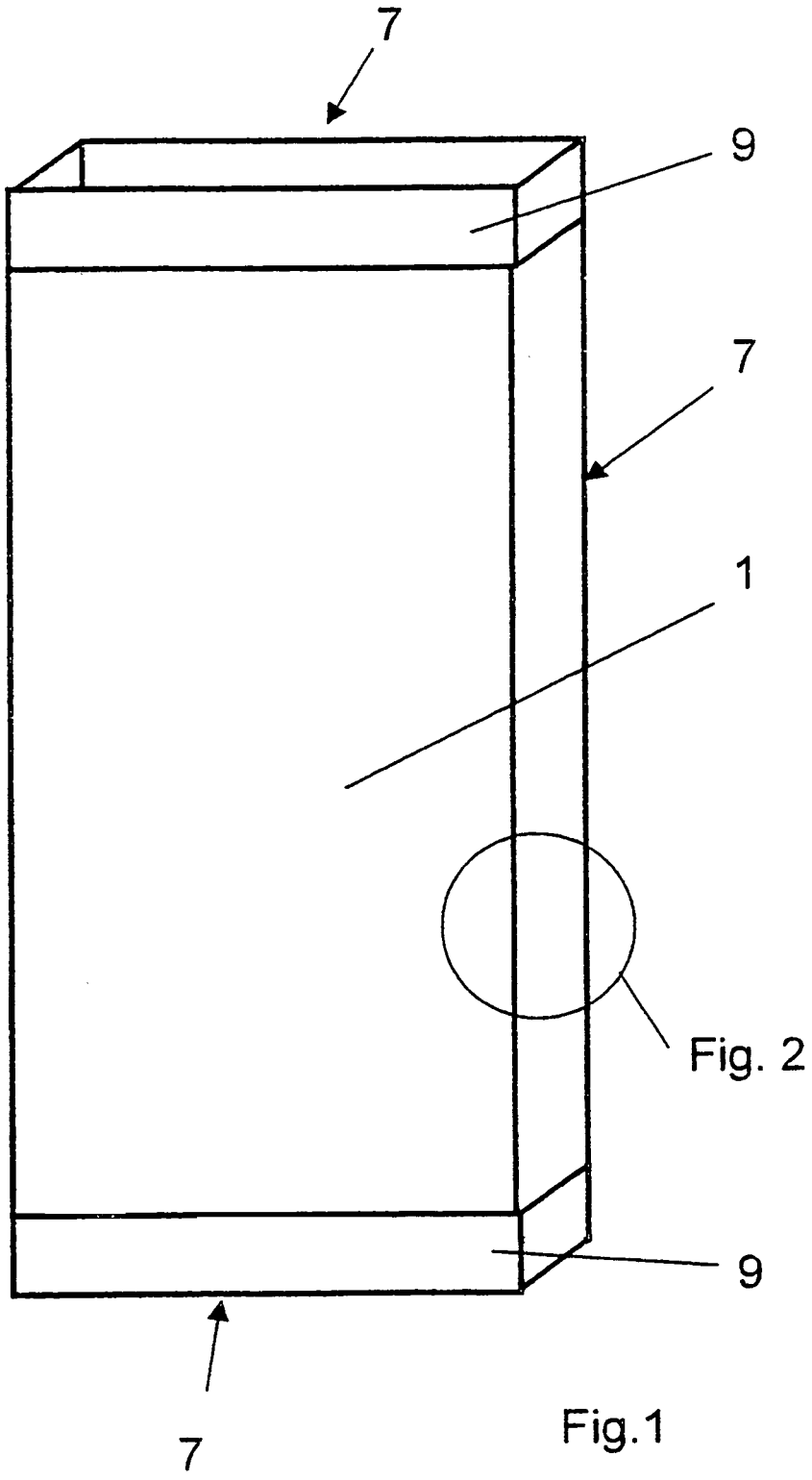
FIG. 1 shows a diagrammatical structure of a wall element.

In the Figures, similar or similarly functioning structural parts are identified by the same reference numerals.

A mobile partitioning wall is composed of several panel-shaped, independently displaceable, suspendedly supported wall elements 1 and is suitable to subdivide a room or to be used as an outside termination, wherein horizontally or vertically disposed mounting elements 9 allow for integrating floor and ceiling terminations, for example. Depending on the execution, the individual wall elements may be displaced manually or by motor power. All wall elements can be moved out of a space-saving parking position, a so-called stacking location, into the axis of the partitioning wall and be braced in that location.

Figure 2:
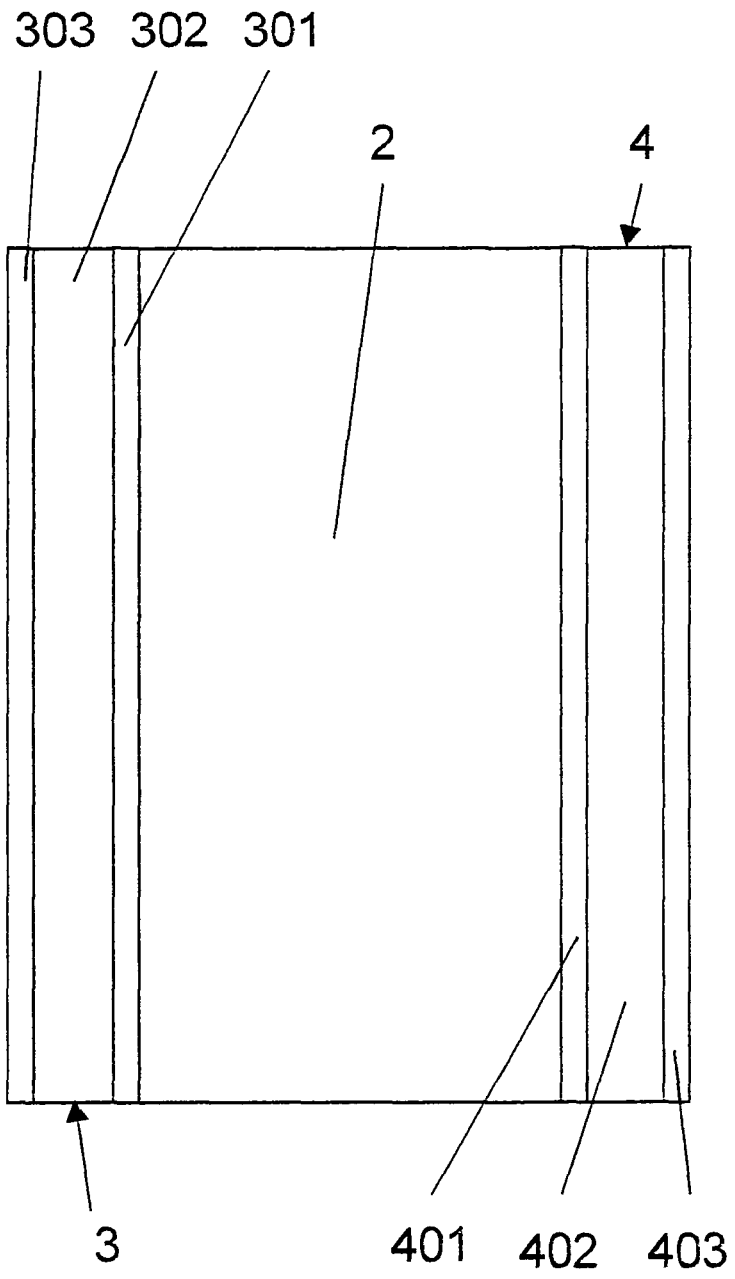
FIG. 2 shows an enlarged diagrammatic layered structure of a wall element shown FIG. 1.

For the sake of clarity, a wall element 1 is only partially illustrated in a cross-section in FIG. 2 with the intention to show the structure in corresponding details.

In the exemplary embodiment, the wall element 1 consists of a core 2 and of exterior shells 3, 4 disposed on both sides. This results in a homologous structure. The exterior shells 3, 4 are formed to be heavy and soundproof and are sonically separated by the preferably soft core material. The exterior shells 3, 4 and the core 2 are combined through a full bonding, in order to form a self-supporting unit.

The core 2 is made from a honeycomb structure, which in particular consists of aluminum or paper. Furthermore, solid material made from polystyrene foam, PU-foam, mineral wool, rock wool or the like can be used.

Both exterior shells 3, 4 are made from several layers and comprise, respectively from the inside, a weighting and sound insulating layer 301, 401, a middle layer 302, 402 made from honeycomb material and of an exterior cover layer 303, 403. The layers are bonded to each other by means of LFI-injection.

Metallic materials, such as sheet steel or sheet aluminum, and plastic material (PVC, PC), laminated materials (GRP), gypsum, wood, cork, etc. are suitable for the middle layers 302 and 402. The layers 302 and 402 serve as the support for the visible cover layers 303 and 403, which may be formed by priming film, laminate, laminar materials, or melamine resin. Furthermore, veneers, textile or glass can be used to form cover layers 303 and 403.

A particularly advantageous structure of the wall element 1 is achieved with a soft core made from PUR integral foam or melamine foam. Preferably, the mass amounts to 25 to 75 $kg/m^3$ with a thickness of 40 to 80 mm. Preferably, the weight per unit area amounts to 10 to 40 $kg/m^2$. A weighting layer 301, 401, made from bitumen, is disposed on both sides and has a thickness of about 5 to 8 mm and a weight per unit area of about 5 to 15 $kg/m^2$. The following middle layer 302, 402 is made from GRP enveloped paper honeycombs filled with PU-foam. Finally, the exterior cover layer 303, 403, which is about 1 to 4 mm thick, is applied to both sides. Such a combination of materials has excellent acoustic properties offering the optimum solution with regard to the parameters of sound insulation and weight per unit area, such as to reach a sound insulation factor of about 55 dB.

Figure 3:
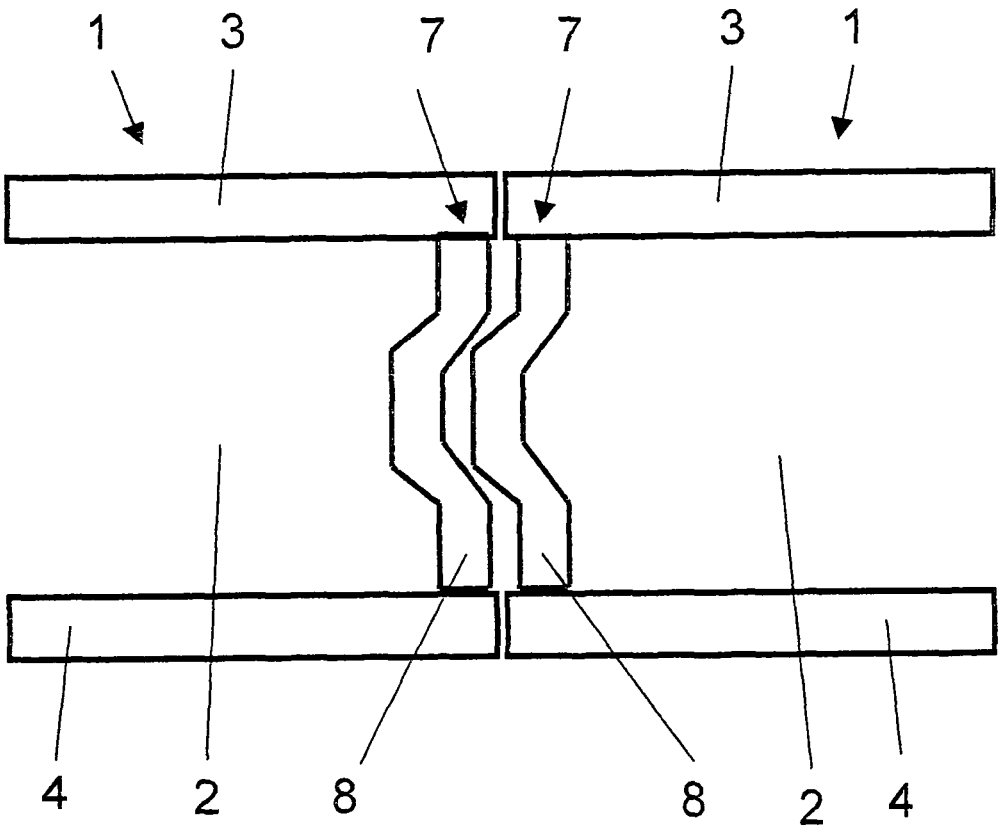
FIG. 3 shows a partial cross-section of adjoining wall elements having a profiled border section.

FIG. 3 shows parts of adjoining wall elements 1 in a cross-section and in particular the configuration of the respective border areas 7 at the vertical edges. Profiled structures 8, which positively and complementarily cooperate, constitute add-on parts which are set in recesses formed in the border areas 7. Alternatively, the profiled structure can be formed directly in the edges.

What is claimed is:

1. A mobile partitioning wall comprising a plurality of wall elements adapted to be displaceably suspended from one or more running rails, at least one of the wall elements comprising:

a core having opposing sides; and first and second exterior shells disposed respectively on the opposing sides of the core, each of the exterior shells comprising an exterior cover layer, a middle layer, and a sound-absorbing weighting interior layer, which are bonded to one another by a fiberglass bonding material;

wherein the exterior shells are fully bonded to the opposing sides of the core so that the core and the exterior shells form a self-supporting unit without a supporting frame; and wherein the at least one of the wall elements has a sound insulation factor of about 55 dB.

2. The mobile partitioning wall of claim 1, wherein profiled contact surfaces are formed between the core and the exterior shells.

3. The mobile partitioning wall of claim 1, wherein each of the wall elements comprises a border area to complement the border area of an adjoining wall element.

4. The mobile partitioning wall of claim 1, wherein each said wall element further comprises at least one mounting element.

5. The mobile partitioning wall of claim 3, wherein the border area comprises a separately formed profiled structure.

6. The mobile partitioning wall of claim 1, wherein the core comprises a honeycomb structure.

7. The mobile partitioning wall of claim 6, wherein the honeycomb structure comprises one of paper and aluminum.

8. The mobile partitioning wall of claim 1, wherein the core comprises one of polystyrene foam, PUR-foam, melamine foam, mineral wool, and rock wool material.

9. The mobile partitioning wall of claim 1, wherein the interior layer comprises a bitumen material.

10. The mobile partitioning wall of claim 1, wherein the middle layer comprises one of metal, plastic, laminar, wood, cork, glass, and gypsum material.

11. The mobile partitioning wall of claim 1, wherein the middle layer comprises a GRP enveloped paper honeycomb filled with PU-foam.

12. The mobile partitioning wall of claim 1, wherein the core of the at least one wall element has a mass of about 25 to 75 kg/m$^3$ and a thickness of about 40 to 80 mm.

13. The mobile partitioning wall of claim 12, wherein the core of the at least one wall element has a weight per unit area of about 10 to 40 kg/m$^2$.

14. The mobile partitioning wall of claim 13, wherein the sound-absorbing weighting layer has a thickness of about 5 to 8 mm and a weight per unit area of about 5 to 15 kg/m$^2$.

15. The mobile partitioning wall of claim 9, wherein the sound-absorbing weighting layer has a thickness of about 5 to 8 mm and a weight per unit area of about 5 to 15 kg/m$^2$.

16. The mobile partitioning wall of claim 14, wherein the core of the at least one wall element is made of at least one of PUR integral foam and melamine foam, and wherein the middle layer of the at least one wall element is made of GRP enveloped paper honeycombs filled with PU-foam.

17. A mobile partitioning wall element adapted to be displaceably suspended from one or more running rails, the wall element comprising:

a core having opposing sides; and exterior shells disposed respectively on the opposing sides of the core, each of the exterior shells comprising an exterior cover layer, a middle layer, and a sound-absorbing weighting interior layer, which are bonded to one another by a fiberglass bonding material;

wherein the exterior shells are fully bonded to the opposing sides of the core so that the core and the exterior shells form a self-supporting unit without a supporting frame; and wherein the wall element has a sound insulation factor of about 55 dB.

18. The mobile partitioning wall element of claim 17 further comprising complementary profiled border areas on opposite vertical edges.

19. A partitioning wall assembly comprising:

a plurality of wall elements adapted to be displaceably suspended from one or more running rails, the wall elements each comprising:

a core having opposite sides; and first and second exterior shells disposed respectively on the opposing sides of the core, each of the exterior shells comprising an exterior cover layer, a middle layer, and a sound-absorbing weighting interior layer, which are bonded to one another by a fiberglass bonding material; and a plurality of mounting elements adapted to be mounted onto the wall elements to adjoin adjacent wall elements to form a partition wall;

wherein the plurality of the wall elements each have a sound insulation factor of about 55 dB.

20. The partitioning wall assembly of claim 19 further comprising complementary profiled border areas on opposite vertical edges of the each of the wall elements.

* * * * *